US005647067A

United States Patent [19]

Boyle

[11] Patent Number: 5,647,067

[45] Date of Patent: Jul. 15, 1997

[54] APPARATUS FOR SELECTIVELY FLUSHING A TOILET WITH EITHER A FULL OR PARTIAL TANK OF WATER

[76] Inventor: Patrick E. Boyle, 179 Rugby La., Gahanna, Ohio 43230

[21] Appl. No.: 645,298

[22] Filed: May 13, 1996

[51] Int. Cl.[6] ..... E03D 1/14

[52] U.S. Cl. ..... 4/325; 4/324; 4/326

[58] Field of Search ..... 4/325, 324, 326, 4/327

[56] References Cited

U.S. PATENT DOCUMENTS

| | | | |
|---|---|---|---|
| 2,931,048 | 4/1960 | Chiappetle et al. | 4/327 |
| 2,962,727 | 12/1960 | Konter et al. | 4/327 |
| 3,758,893 | 9/1973 | Smolinski et al. | 4/327 |
| 3,906,554 | 9/1975 | Johnson | 4/327 |
| 3,916,455 | 11/1975 | Longdin | 4/327 |

*Primary Examiner*—David J. Walczak

[57] ABSTRACT

The apparatus includes control mechanisms which are rotatably secured to the front of the toilet tank for operation and control by a user. The control mechanisms include a first short flush handle adapted for rotation about a horizontal axis and a second normal long flush handle adapted for rotation independent of the rotation of the short flush handle and about the same axis of rotation. A rod in the upper extent of the tank is coupled at its inboard end to the short flush handle with a first mechanism coupled to the remote and thereof coupled to the aperture of the flush plug for raising the flush plug upon the rotation of the short flush handle. A long rod is secured to the flush handle for rotational movement with respect to the normal flush handle and with an exterior end which has an aperture and a second mechanism. The upper end of the second mechanism is secured to the exterior end of the normal flush handle. The lower end of the second mechanism is coupled to the aperture of the normal long flush handle whereby the user may rotate the short handle for a less than full flush and rotate the normal long flush handle for an entire flush of the water in the toilet tank.

1 Claim, 3 Drawing Sheets

APPARATUS FOR SELECTIVELY FLUSHING A TOILET WITH EITHER A FULL OR PARTIAL TANK OF WATER

BACKGROUND OF THE INVENTION

1. Field of the Invention

The present invention relates to an apparatus for selectively flushing a toilet with either a full or partial tank of water and more particularly pertains to flushing a toilet in the normal fashion or, in the alternative with a quantity of water from the tank of a limited amount when so desired.

2. Description of the Prior Art

The use of devices for flushing toilets is known in the prior art. More specifically, devices for flushing toilets heretofore devised and utilized for the purpose of flowing a preselected amount of water therethrough are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 4,651,359 to Battle a dual mode flush valve assembly.

U.S. Pat. No. 5,003,644 to Huang discloses a two-stage water discharge mechanism for flush toilet tank.

U.S. Pat. No. 5,129,110 to Richter discloses a selectable toilet-water-level flushing system.

U.S. Pat. No. 5,157,796 to Boyer discloses a double flush toilet valve.

U.S. Pat. No. 5,205,000 to Xia, Luo and Zhang discloses a dual water-level toilet flushing apparatus.

In this respect, the apparatus for selectively flushing a toilet with either a full or partial tank of water according to the present invention substantially departs from the conventional concepts and designs of the prior art, and in so doing provides an apparatus primarily developed for the purpose of flushing a toilet in the normal fashion or, in the alternative with a quantity of water from the tank of a limited amount when so desired.

Therefore, it can be appreciated that there exists a continuing need for a new and improved apparatus for selectively flushing a toilet with either a full or partial tank of water which can be used for flushing a toilet in the normal fashion or, in the alternative with a quantity of water from the tank of a limited amount when so desired. In this regard, the present invention substantially fulfills this need.

SUMMARY OF THE INVENTION

In view of the foregoing disadvantages inherent in the known types of devices for flushing toilets now present in the prior art, the present invention provides an improved apparatus for selectively flushing a toilet with either a full or partial tank of water. As such, the general purpose of the present invention, which will be described subsequently in greater detail, is to provide a new and improved apparatus for selectively flushing a toilet with either a full or partial tank of water which has all the advantages of the prior art and none of the disadvantages.

To attain this, the present invention essentially comprises a flush valve pivotally positioned in a toilet tank to be seated at the upper end of an associated pipe when in the closed position and adapted to be raised to an elevated orientation for allowing the water of the entire flush tank to be dispensed for flushing the toilet, the flush valve having a circular opening in the upper extent thereof with one side of the flush valve pivotally secured to a fixed portion of the toilet and constituting a pivot point and with the opposite end of the flush valve being provided with an aperture; a short flush plug being positionable in the opening of the flush valve and having a central extent recipricable vertically therein, the short flush valve having an upper collar which when lowered, will seat on the opening of the upper surface of the flush valve for the closure thereof, the short flush plug liftable to an elevated orientation to allow the flow of water into and through the flush valve and into the toilet for a flush with a quantity of water less than the full tank, the lower end of the flush plug being provided with a shoulder to preclude excess motion thereof which would tend to unseat the flush valve, the upper end of the flush plug being provided with an aperture; and control mechanisms rotatably secured to the front of the toilet tank for operation and control by a user, the control mechanisms including a first short flush handle adapted for rotation about a horizontal axis and a second normal long flush handle adapted for rotation independent of the rotation of the short flush handle and about the same axis of rotation, a rod in the upper extent of the tank coupled at its inboard end to the short flush handle with a first chain coupled to the remote end thereof coupled to the aperture of the flush plug for raising the flush plug upon the rotation of the short flush handle and with a long rod secured for rotational movement with respect to the normal flush handle and with an exterior end having an aperture and a second chain, the upper end of the second chain being secured to the exterior end of the normal flush handle and the lower end of the second chain coupled to the aperture of the normal long flush handle whereby the user may rotate the short handle for a less than full flush and rotate the normal long flush handle for an entire flush of the water in the toilet tank.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved apparatus for selectively flushing a toilet with either a full or partial tank of water which has all the advantages of the prior art devices for flushing toilets and none of the disadvantages.

It is another object of the present invention to provide a new and improved apparatus for selectively flushing a toilet with either a full or partial tank of water which may be easily and efficiently manufactured and marketed.

It is a further object of the present invention to provide a new and improved apparatus for selectively flushing a toilet with either a full or partial tank of water which is of a durable and reliable construction.

An even further object of the present invention is to provide a new and improved apparatus for selectively flushing a toilet with either a full or partial tank of water which is susceptible of a low cost of manufacture with regard to both materials and labor, and which accordingly is then susceptible of low prices of sale to the consuming public, thereby making such apparatus for selectively flushing a toilet with either a full or partial tank of water economically available to the buying public.

Still yet another object of the present invention is to provide a new and improved apparatus for selectively flushing a toilet with either a full or partial tank of water which provides in the apparatuses and methods of the prior art some of the advantages thereof, while simultaneously overcoming some of the disadvantages normally associated therewith.

Still another object of the present invention is to flush a toilet in the normal fashion or, in the alternative with a quantity of water from the tank of a limited amount when so desired.

Lastly, it is an object of the present invention to provide a new and improved apparatus including control mechanisms which are rotatably secured to the front of the toilet tank for operation and control by a user. The control mechanisms include a first short flush handle adapted for rotation about a horizontal axis and a second normal long flush handle adapted for rotation independent of the rotation of the short flush handle and about the same axis of rotation. A rod in the upper extent of the tank is coupled at its inboard end to the short flush handle with a first mechanism coupled to the remote and thereof coupled to the aperture of the flush plug for raising the flush plug upon the rotation of the short flush handle. A long rod is secured to the flush handle for rotational movement with respect to the normal flush handle and with an exterior end which has an aperture and a second mechanism. The upper end of the second mechanism is secured to the exterior end of the normal flush handle. The lower end of the second mechanism is coupled to the aperture of the normal long flush handle whereby the user may rotate the short handle for a less than full flush and rotate the normal long flush handle for an entire flush of the water in the toilet tank.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
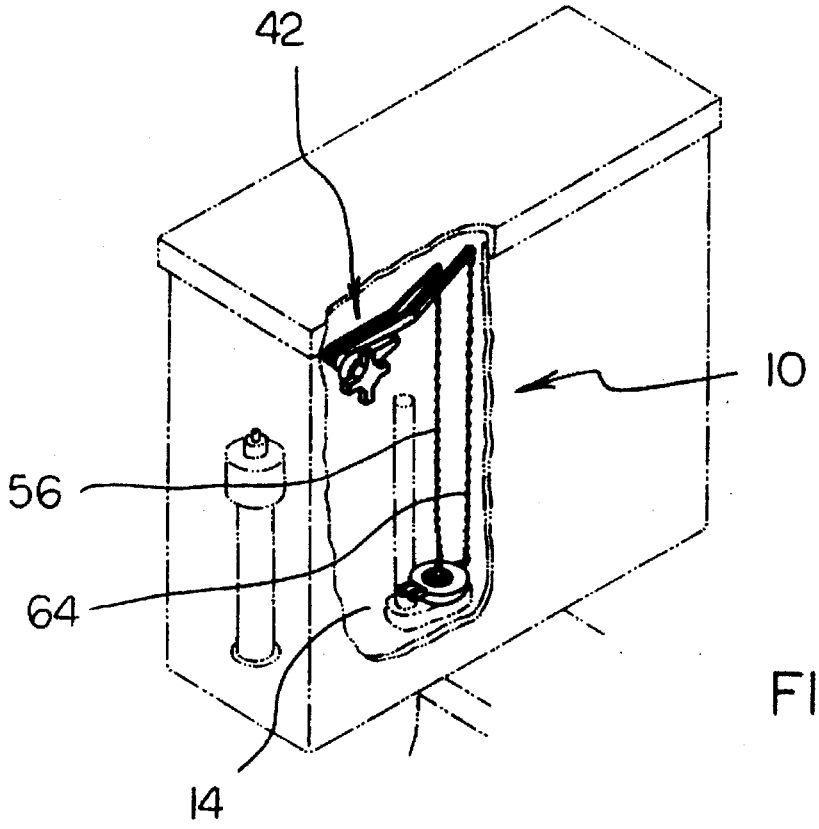
FIG. 1 is a perspective illustration of the preferred embodiment of the apparatus for selectively flushing a toilet with either a full or partial tank of water constructed in accordance with the principles of the present invention.
Figure 2:
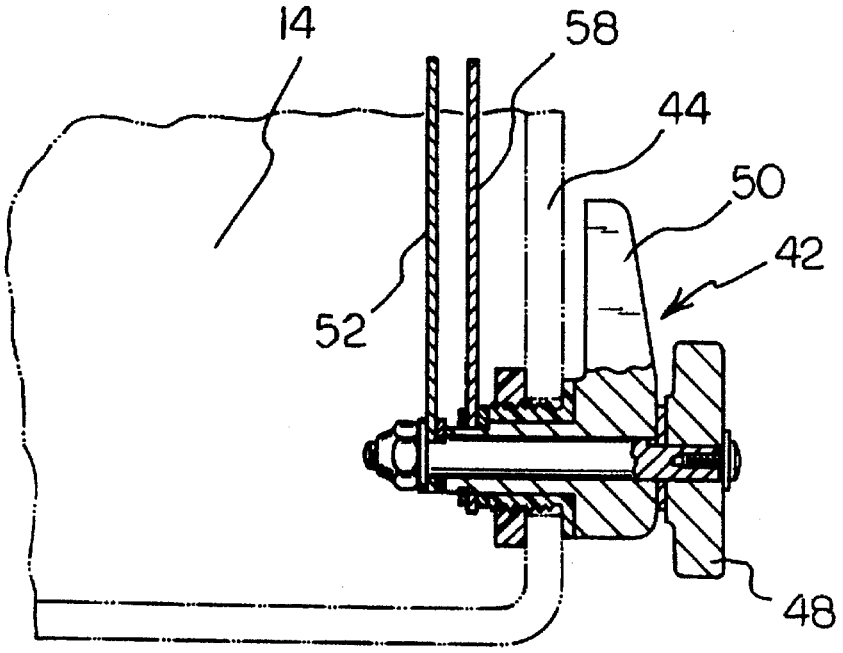
FIG. 2 is a top elevational view, partially in section of the control mechanisms for the device illustrated in FIG. 1.
Figure 3:
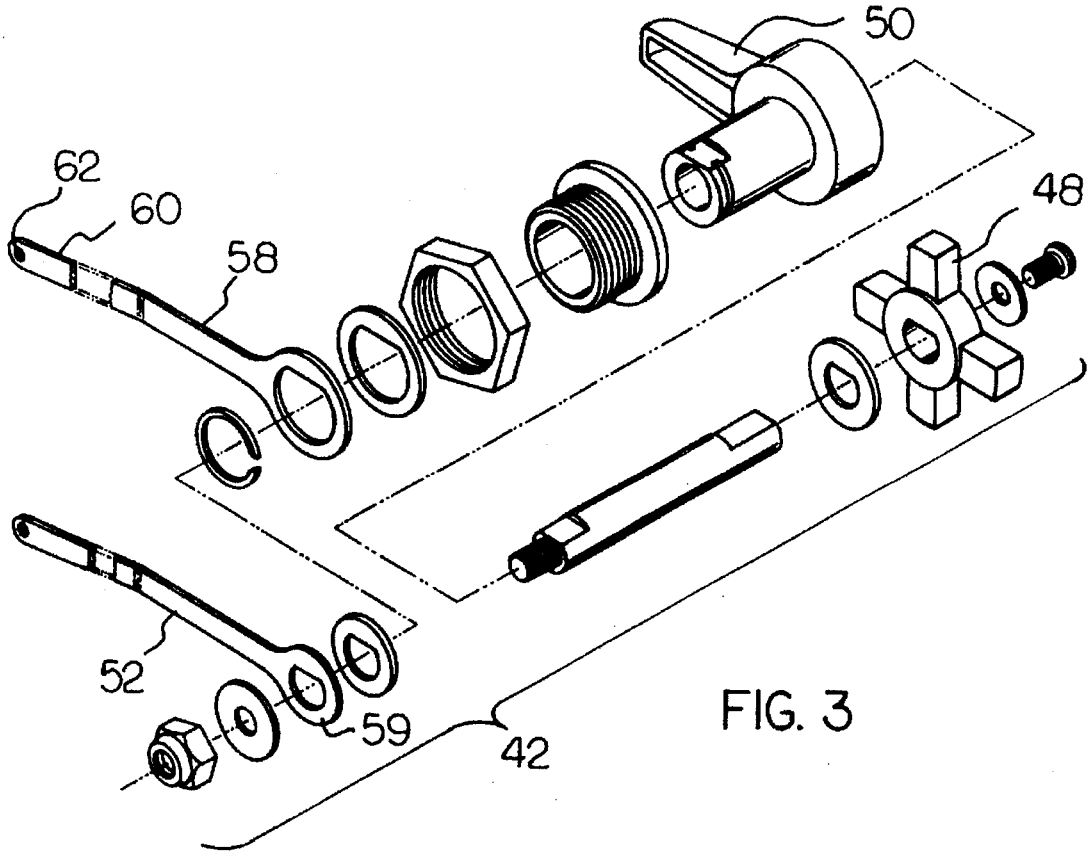
FIG. 3 is an exploded perspective view of the actuator mechanisms shown in FIG. 2.
Figure 4:
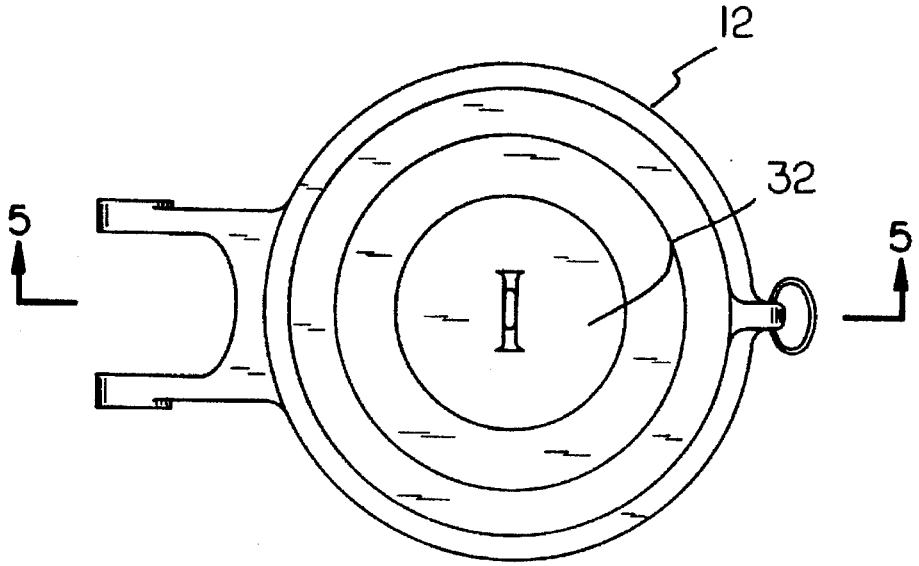
FIG. 4 is a top elevational view of the flush valve as illustrated in FIG. 1.
Figure 5:
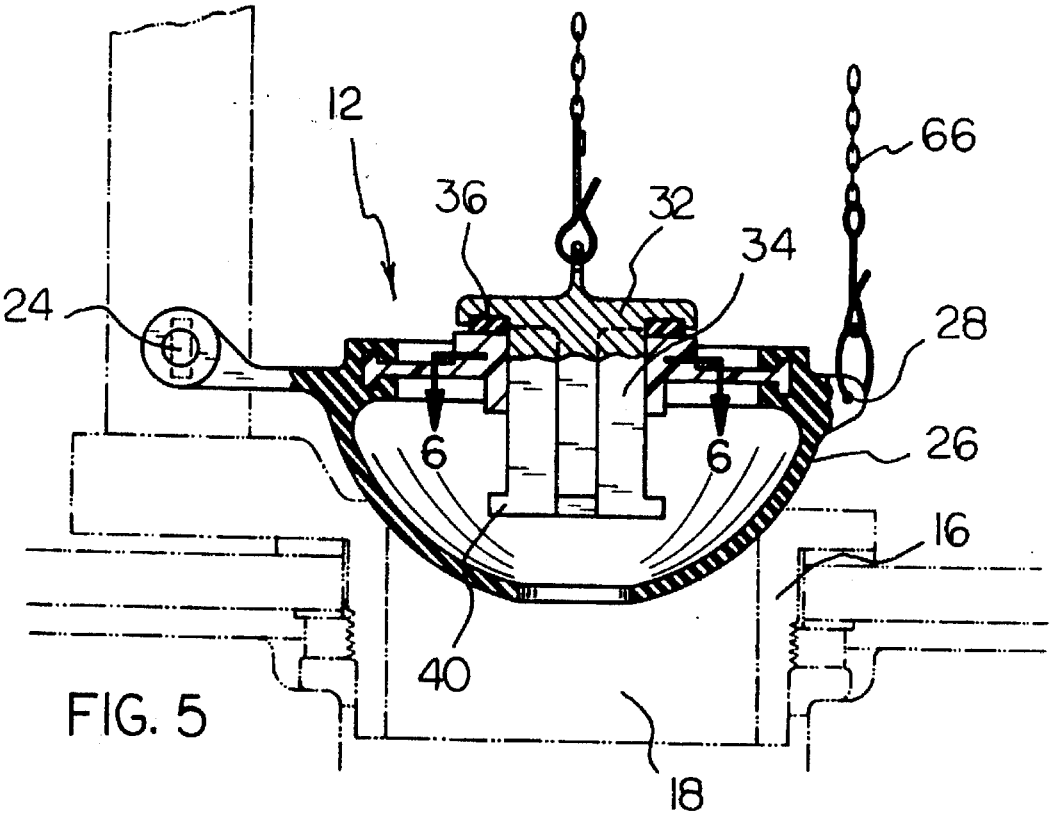
FIG. 5 is a cross-sectional view of the flush valve taken along line 5—5 of FIG. 4.
Figure 6:
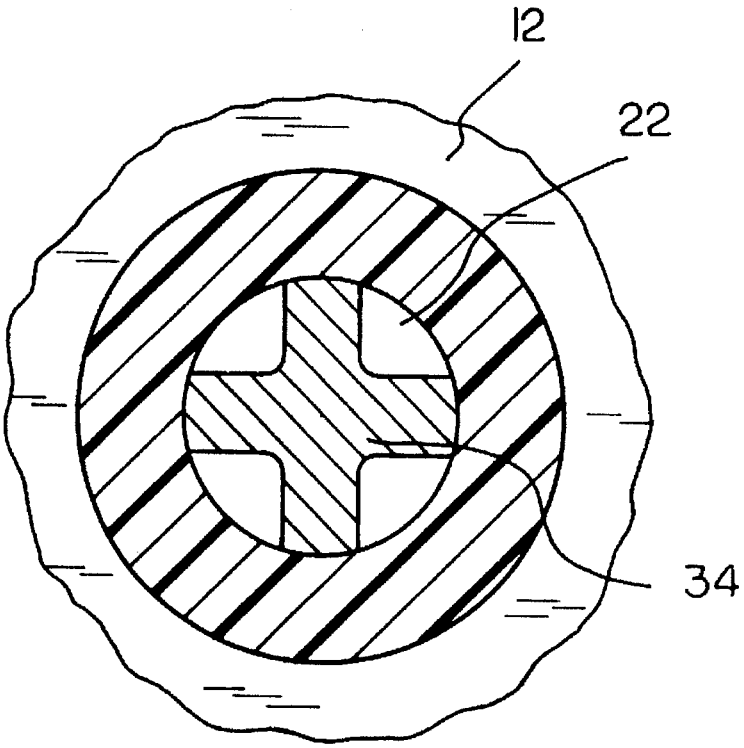
FIG. 6 is a cross-sectional view of the central part of the flush valve including the flush plug taken along the line 6—6 of FIG. 5.

With reference now to the drawings, and in particular to FIG. 1 thereof, a new and improved apparatus for selectively flushing a toilet with either a full or partial tank of water embodying the principles and concepts of the present invention and generally designated by the reference numeral 10 will be described.

The present invention, the new and improved apparatus for selectively flushing a toilet with either a full or partial tank of water, is comprised of a plurality of components. Such components in their broadest context include a flush valve, plug, and control mechanisms. Such components are individually configured and correlated with respect to each other so as to attain the desired objective.

More specifically, the central component of the system 10 is a flush valve 12. The flush valve is pivotally positioned in a toilet tank 14 to be seated at the upper end 16 of an associated pipe 18 when in the closed position. The flush valve is also adapted to be raised to an elevated orientation for allowing the water of the entire flush tank to be dispensed for flushing the toilet in a normal manner.

The flush valve is constructed with a circular aperture in the upper extent thereof. One side of the flush valve is pivotally secured to a fixed portion 24 of the toilet. This constitutes the pivot point for the flush valve. The opposite end 26 of the flush valve is provided with an aperture 28.

Next provided is a short flush plug 32. The short flush plug is positionable in the aperture of the flush valve when in the closed position. The short flush plug has a central extent 34 recipricable vertically within such aperture. The short flush valve also has an upper collar 36. When lowered, such collar will seat in the opening of the upper surface of the flush valve for the closure thereof.

The short flush plug is liftable to an elevated orientation. When so elevated, it will allow the flow of water into and through the flush plug and into the toilet. This will effect a flush with a quantity of water less than the full tank. The short flush plug is non-buoyant and reseals itself automatically due to the water pressure within the tank.

The lower end of the flush plug is provided with a shoulder 40. Such shoulder is to preclude excess motion thereof axially which, otherwise, would tend to unseat the flush plug from its location within the flush valve. The upper end of the flush plug is provided with an aperture for controlling its motion. Next provided are a plurality of controlled mechanisms 42. Such control mechanisms are rotatably secured to the front 44 of the toilet tank. They are for operation and control by the user.

The control mechanisms include a first short flush handle 48. Such handle is adapted for rotation about a horizontal axis. Also included as part of the control mechanism is a second normal long flush handle 50. Such handle is adapted for rotation independent of the rotation of the short flush handle. It is rotatable about the same axis of rotation. A rod 52 in the upper extent of the tank is coupled at its inboard end 59 to the short flush handle. A first chain is coupled to the remote end of the rod with the other end 56 of the chain coupled to the aperture of the flush plug. This is for raising the flush plug upon the rotation of the short flush handle. A containment member 57 with a U-shaped configuration is coupled to the control mechanisms for precluding the rod 52 from being elevated past a point at which the flush valve 12 would be raised. A long rod 58 is secured for rotational movement with respect to the normal flush handle. Such rod has an exterior end 60 with an aperture 62 coupled to the upper end of a second chain 64. The upper end of the second chain is thus secured to the exterior end of the normal flush handle. At its lower end 66 the second chain is coupled to the aperture of the flush valve. In this manner, the user may rotate the short handle for a less than full flush. The user may rotate the long flush handle for an entire normal flush of all the water in the tank.

The present invention will replace a normal flush operation on a toilet. The idea is to have a two part flush handle, the outside smaller handle will raise a small flush plug inside the normal main rubber round flush cover inside the toilet tank and allow a small amount of water to flush into the toilet bowl, about a gallon or so, then reseal itself and allow the toilet tank to refill. It should be noted that the outside smaller handle is manually controlled to allow more or less water to be released as needed. Water thus can be selectively governed by a user to accommodate different sized bowls and flush requirements. The inside main flush handle will allow a normal full flush of the toilet bowl.

The intended purpose is to flush the toilet bowl of smelly liquid waste which would take just the small amount of water; when a full flush is not necessary, no toilet paper or other wastes. This would save thousands or when enough people get them millions or billions of gallons of water per year. Could easily be installed in existing toilets.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An apparatus for selectively flushing a toilet bowl with either a full or partial amount of water from a toilet tank associated with the toilet bowl, comprising:

a toilet tank with an associated pipe;

a flush valve pivotally positioned in the toilet tank to be seated at an upper end of the associated pipe when in a closed position and adapted to be raised to an elevated orientation for allowing the water of the entire toilet tank to be dispensed, the flush valve having a circular opening in an upper extent thereof with one side of the flush valve pivotally secured to a fixed portion of the toilet tank and constituting a pivot point and with the opposite end of the flush valve being provided with an aperture;

a short flush plug being positionable in the opening of the flush valve and having a central extent which is reciprocably vertically mounted therein, the short flush valve having an upper collar which when lowered, will seat on the opening of the upper extent of the flush valve for effecting the closure thereof, the short flush plug liftable to an elevated orientation to allow the flow of water into and through the flush valve and into the toilet for a flush with a quantity of water less than a full tank, the flush plug having a lower end and an upper end, the lower end of the flush plug being provided with a shoulder to preclude excess motion thereof which would tend to unseat the flush plug, the upper end of the flush plug being provided with an aperture; and control mechanisms rotatably secured to a front of the toilet tank for operation and control by a user, the control mechanisms including a first short flush handle adapted for rotation about a horizontal axis and a second normal long flush handle adapted for rotation independent of the rotation of the short flush handle and about a same axis of rotation, the control mechanisms including a rod in an upper extent of the toilet tank coupled at an inboard end thereof to the short flush handle with a first chain coupled between a remote end of the rod and the aperture of the flush plug for raising the flush plug upon the rotation of the short flush handle and a long rod secured for rotational movement with respect to the normal long flush handle and with an exterior end having an aperture for coupling with a second chain, the second chain having an upper end being secured between the exterior end of the normal long flush handle and the aperture of the flush valve whereby the user may rotate the short handle for a less than full flush and rotate the normal long flush handle for an entire flush of the water in the toilet tank.

* * * * *